US005328061A

United States Patent [19]

Libit et al.

[11] Patent Number: 5,328,061

[45] Date of Patent: Jul. 12, 1994

[54] SLIDING DISPENSING CAP AND DISPENSING STOPPER

[75] Inventors: Jeffrey M. Libit, 13244 Circulo Largo Ct., NE., Albuquerque, N. Mex. 87112; Sidney Libit, Long Boat Key, Fla.

[73] Assignee: Jeffrey M. Libit, Albuquerque, N. Mex.

[21] Appl. No.: 978,406

[22] Filed: Nov. 18, 1992

[51] Int. Cl.[5] ..... B65D 37/00

[52] U.S. Cl. ..... 222/212; 222/479; 222/482; 222/484; 222/532

[58] Field of Search ..... 222/211, 212, 479, 481, 222/481.5, 482, 484, 531, 532

[56] References Cited

U.S. PATENT DOCUMENTS

| | | | |
|---|---|---|---|
| D. 329,814 | 9/1992 | Libit | D9/526 |
| 4,408,703 | 10/1983 | Libit | 222/284 |
| 4,429,815 | 2/1984 | Libit | 222/452 |
| 4,600,130 | 7/1986 | Libit | 222/211 X |
| 5,033,654 | 7/1991 | Bennett | 222/211 X |
| 5,048,750 | 9/1991 | Tobler | 222/212 X |
| 5,054,634 | 10/1991 | Margotteau | 222/531 X |
| 5,110,051 | 5/1992 | Bennett | 222/212 X |
| 5,114,051 | 5/1992 | Simon | 222/531 X |
| 5,115,946 | 5/1992 | Libit | 222/212 X |
| 5,115,949 | 5/1992 | Rosenthal | 222/212 X |

FOREIGN PATENT DOCUMENTS

| | | | |
|---|---|---|---|
| 9168 | 1/1989 | Japan | 222/212 |

*Primary Examiner*—Karen B. Merritt
*Assistant Examiner*—Kenneth Bomberg
*Attorney, Agent, or Firm*—Hill, Steadman & Simpson

[57] ABSTRACT

A slide dispensing cap and dispensing stopper for a dispensing bottle which includes a one-way valve between the interior of the bottle and the cap so that air cannot enter into the bottle when product is dispensed through a tube because the valve closes to prevent product from passing through the one-way valve. A tube communicates with the stopper and in a dispensing position of the slide nozzle so that product can pass out through the nozzle. After dispensing the bottle is released and air can enter the bottle through the one-way valve.

2 Claims, 2 Drawing Sheets

FIG. 1
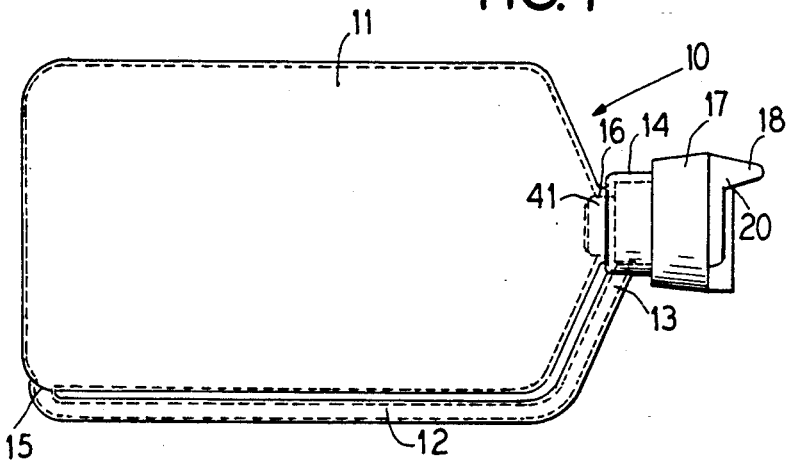
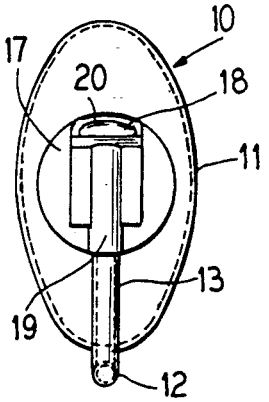
FIG. 2
FIG. 3
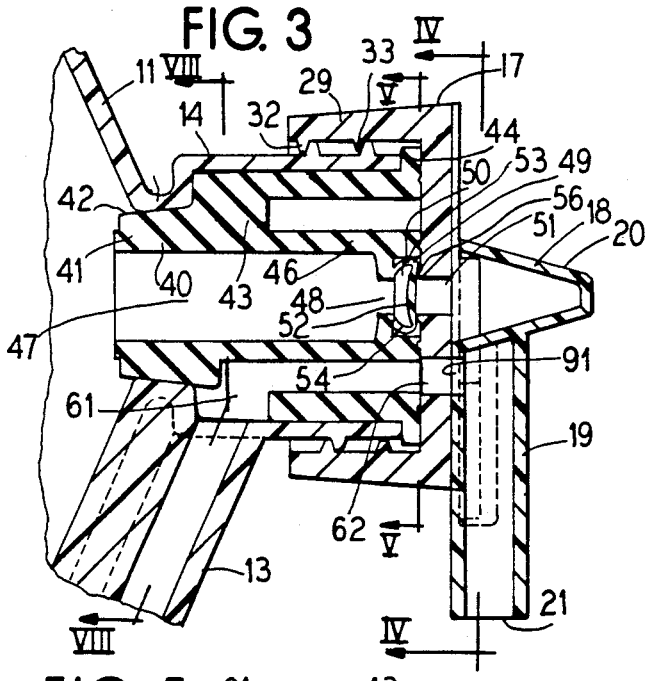
FIG. 4
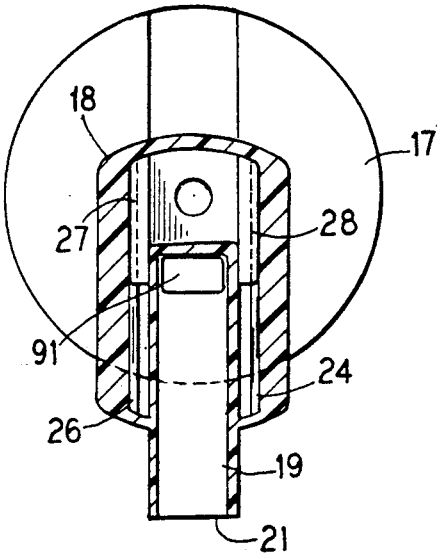
FIG. 5
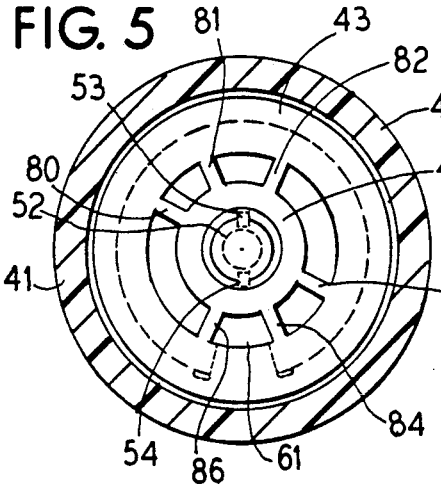
FIG. 6
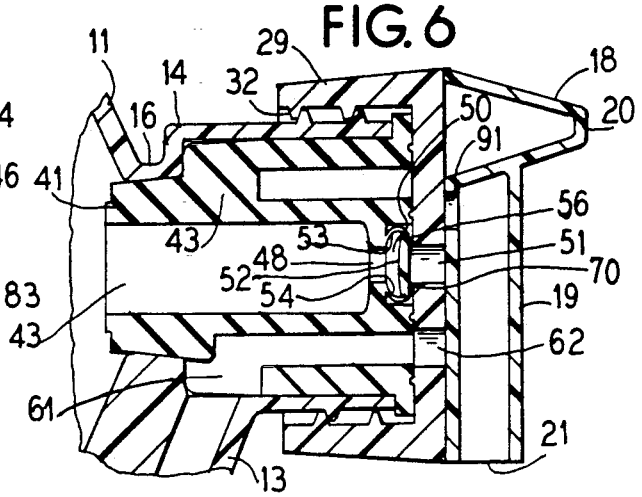

FIG 7
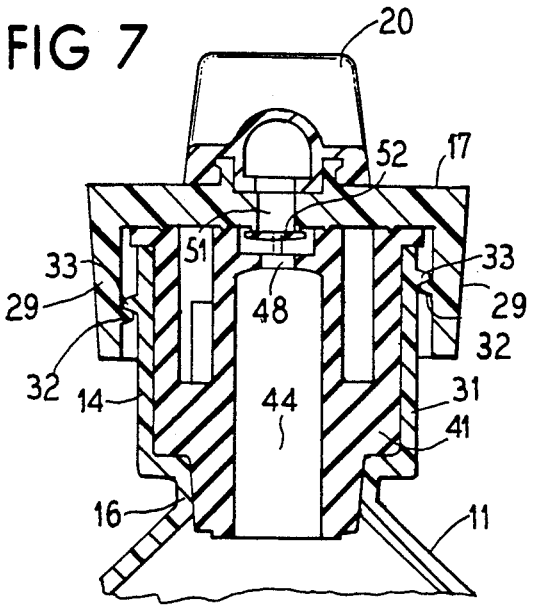
FIG 8
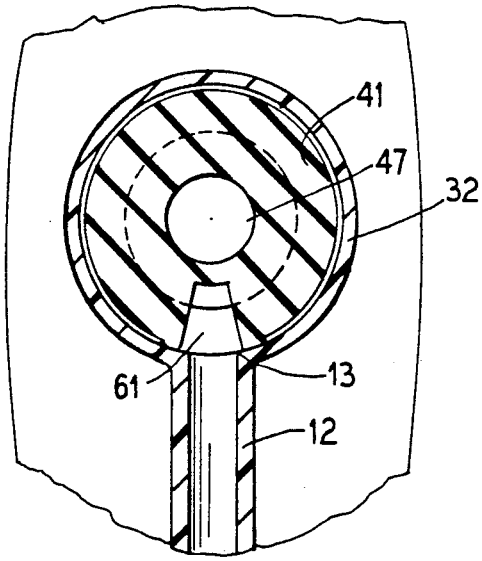
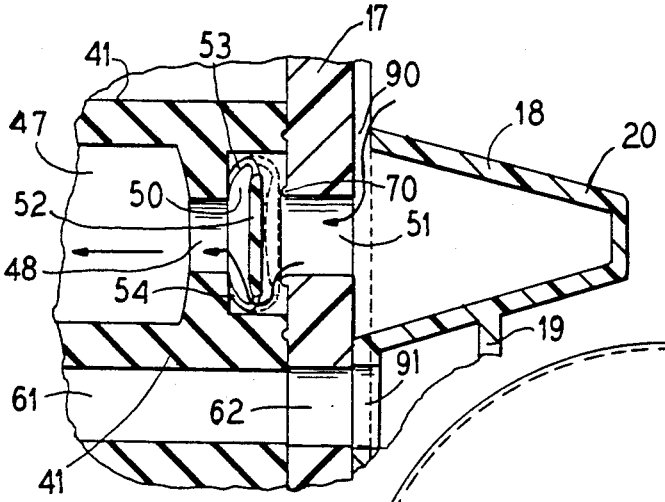
FIG 9
FIG 10
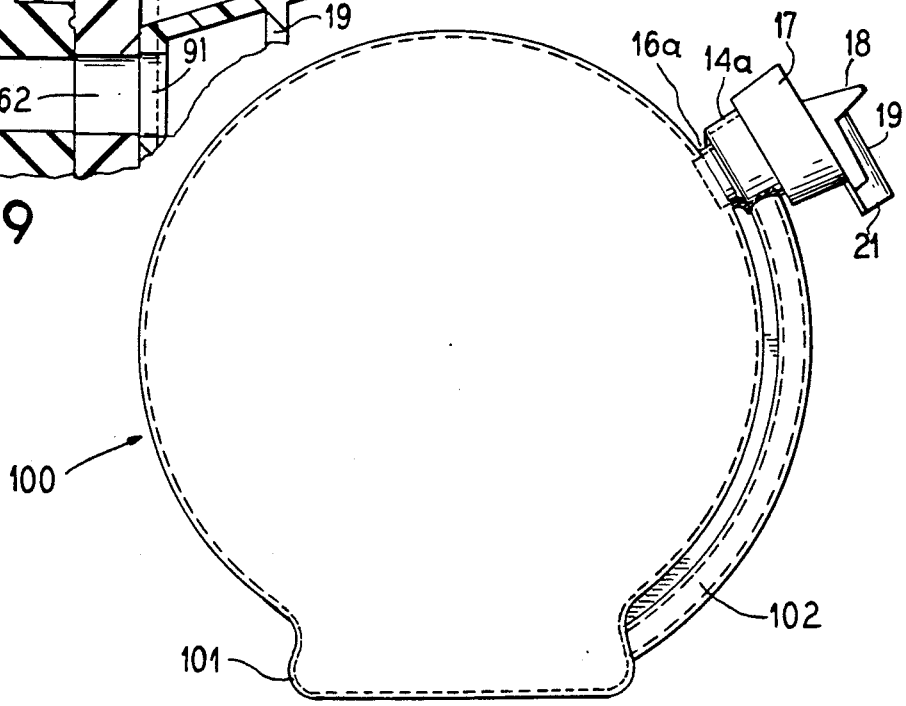

SLIDING DISPENSING CAP AND DISPENSING STOPPER

CROSS-REFERENCES TO RELATED APPLICATIONS

The present application is related to Design patent application Ser. No. 594,991 filed Oct. 4, 1990 now U.S. Pat. No. 329,814, in which the inventor is Sidney M. Libit and application Ser. No. 653,508 filed Feb. 11, 1991 now U.S. Pat. No. 5,115,946 entitled "SQUEEZE BOTTLE" in which the inventor is Sidney M. Libit.

BACKGROUND OF THE INVENTION

1. Field of the Invention

This invention relates in general to dispenser bottles and in particular to a novel squeeze bottle which has a sliding dispenser cap and a dispenser stopper.

2. Description of Related Art

Various dispensing bottles are known such as are shown in U.S. Pat. Nos. 4,408,703 and 4,429,815.

SUMMARY OF THE INVENTION

The present invention comprises a novel squeeze bottle which has a dispensing tube which is integrally formed with the bottle and which extends on the outside thereof and is attached to the outer surface of the bottle and which has a receiving end that extends into the container. When the bottle is squeezed, the product is forced up through the dispensing tube and through a radial opening formed in the stopper and out an orifice into the sliding dispensing nozzle. After dispensing the product, the slide nozzle is moved so as to close the dispensing orifice and air can pass under the slide nozzle into a central orifice through a one-way valve formed in the stopper into the container to fill it with air. During the dispensing cycle the one-way valve prevents air from exiting from the container so that the product is forced up through the discharge tube.

Various products can be dispensed such as cosmetics, liquid soaps, lotions, shampoos, and foods such as oil, ketchup, mustard. Also cleaners such as detergents and wax can be dispensed with the novel dispensing container of the invention.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure, and in which:

BRIEF DESCRIPTION OF THE DRAWINGS

FIG. 1 is a side plan view of the dispensing bottle of the invention;

FIG. 2 is a top plan view of the dispensing bottle;

FIG. 3 is a sectional view of the stopper and slide dispensing mechanism of the invention;

FIG. 4 is a top plan view of the slide dispenser of the invention taken on line IV—IV of FIG. 3;

FIG. 5 is a sectional view taken on line V—V of FIG. 3;

FIG. 6 is a sectional view with the slide nozzle in the off position;

FIG. 7 is a sectional view transverse to FIG. 3;

FIG, 8 is a sectional view taken on VIII—VIII of FIG, 3;

FIG. 9 is a sectional view illustrating the one-way valve in the open position; and FIG. 10 is a side plan view of a modified form of the invention.

DESCRIPTION OF THE PREFERRED EMBODIMENTS

FIGS. 1 and 2 illustrate flexible bottle 10 with a dispenser stopper and nozzle.

A bottle 11 has an integrally formed dispensing tube 12 attached to one side thereof which has a fluid connection 15 with the bottom of the bottle 11. The tube 12 has a portion 13 which extends up to the stopper and dispensing nozzle. The bottle 11 has a reduced orifice 16 which is connected to a larger cylindrical portion 14 as shown in FIGS. 3, 6 and 7. A stopper 41 has a first portion 40 which is receivable in the reduced portion 16 of the bottle and has an enlarged portion 43 that is received in the portion 14 of the bottle. A flange 44 is formed on one end of the stopper 41 and engages the upper end of the enlarged portion 14. A central opening 47 extends through the stopper 41 from inside the bottle to a smaller orifice 48 which communicates with a valve chamber 50 in which a one-way valve 52 is mounted. The flap valve 52 is formed with a pair of flexible legs 53 and 54 which bias it to the right relative to FIG. 3 in the valve chamber 50. A dispenser lid 17 is formed with internal threads 33 which mate with external threads 32 on the bottle portion 14 so that the lid 17 can be attached to the bottle. The lid 17 has a central passage 51 which aligns with the valve chamber 50. The lid 17 also has an opening 91 which aligns with a passageway 61 that is fluidly connected with the end of dispenser tube 13 as shown in FIG. 3. A slide dispenser 18 is mounted on the cap 17 and is moveable in grooves 24 and 26 which engage edges 27 and 28 of the dispenser 18 as shown, for example, in FIG. 4.

As shown in FIG. 5, the stopper 41 is formed with an opening 61 that communicates with the end 13 of tube 12. A first pair of webs 84 and 86 extend radially inwardly on either side of passage 61 to the center portion 46 of the stopper. Other webs 80, 81, 82 and 83 also extend between the outer portion of the stopper and the central portion 46 as shown. The slide nozzle 18 has a thumb portion 20 and an air passage 90 is formed between the slide nozzle 18 and the opening 51 through the cover 17 so that air can pass as shown by the arrow in FIG. 9 and the air passes through the opening 51 by one-way valve 52 into the opening 48 and opening 47 of the stopper and into the bottle 11 to fill it with air after product has been dispensed. FIG. 8 is a sectional view on line VIII—VIII in FIG. 3 and illustrates the communication of the tube 12 and its end 13 with the opening 61. The downwardly extending sidewalls 29 of the cover 17 are provided with threads 33 which mate with the threads 32 so that the opening 62 aligns with the opening 61 as shown in FIG. 9, for example.

In operation, the slide nozzle 18 is moved to the position shown in FIG. 3 and the bottle 11 is compressed by the user so as to force product through the opening 15 and tube 12 then through tube portion 13 into the opening 61 and through the opening 62 in the cap 17 and through opening 91 in the slide dispenser 18 and out nozzle 19 when it has been moved to the dispensing position as shown in FIG. 3. The product enters the discharge nozzle 19 and is ejected from the end opening 21. After the product has been ejected, the compression force on the bottle 11 will be removed by the operator such that air can pass through opening 90 and through opening 51 pass the one-way valve 52 into the opening 47 and enter the bottle 11. The one-way valve 52 is closed when the bottle 11 is compressed by the user to eject product because the inside pressure in the bottle moves the valve 52 to the right relative to FIG. 9 so that it seats on the valve seat 70 of the lid 17 which is formed about the opening 51 above the valve chamber 50.

After use, the nozzle slide 18 may be returned to the position shown in FIG. 6 so that the opening 91 does not align with the opening 62 in the cover 17. At this time, air can pass through the openings 90 under the slide 18 and through opening 51 and one-way valve 52 into the bottle.

FIG. 10 illustrates a modified form of the bottle wherein a disc-shaped bottle 100 is formed with a base 101. The bottle has a dispensing tube 102. The reduced portion of the neck 16*a* and the enlarged portion 14*a* are the same as in the embodiment illustrated in FIG. 1 and the lid 17 and slide nozzle 18 and the internal stopper construction are the same as in the first embodiment.

Although the invention has been described with respect to preferred embodiments, it is not to be so limited as changes and modifications can be made which are within the full intended scope of the invention as defined by the appended claims.

We claim as our invention:

1. A bottle for dispensing a product comprising, a flexible bottle with a neck portion, a flexible tube integrally formed with the bottle and with a first end connected to a bottom portion of the bottle and a second end connected to said neck portion, a stopper received in said neck portion and formed with a first opening which communicates with said second end of said flexible tube, a dispenser cap connected to said bottle above said stopper and formed with a second opening which communicates with said first opening in said stopper which communicates with said second end of said tube, a slide with a dispensing nozzle moveably connected to said dispenser cap and formed with a third opening which can be moved to communicate with said second opening in said dispenser cap to dispense said product, and a one-way valve mounted in said bottle which prevents product and air from passing therethrough when said bottle is compressed by a user and which allows air to pass into said bottle when said user releases said bottle, wherein said one-way valve is mounted in said stopper, said stopper including a fourth opening formed therethrough and said one-way valve mounted in said opening, wherein said one way valve is mounted in a valve chamber formed in said fourth opening of said stopper, wherein said one-way valve comprises a disc mounted in said valve chamber, and a valve seat formed in said valve chamber such that said disc seats against said valve seat when said flexible bottle is compressed, said disc including flexible legs attached thereto to bias it toward said valve seat, wherein a fifth opening is formed in said dispenser cap which is aligned with said fourth opening formed through said stopper, and said slide with said dispensing nozzle is slidable mounted in said dispenser cap such that it can be moved to a non-dispensing position such that said third opening does not communicate with said second opening in said dispenser cap, and an air passage is formed between said slide and said fifth opening through the dispenser cap so that air can pass into said bottle through said one-way valve when said user releases said bottle.

2. A bottle for dispensing according to claim 1 including a thumb actuator mounted on said slide.

* * * * *